US011128095B2

(12) United States Patent
Conte et al.

(10) Patent No.: US 11,128,095 B2
(45) Date of Patent: Sep. 21, 2021

(54) METHOD FOR ALIGNING A CRIMPER OF A FIRST TOOL OF A CRIMPING PRESS RELATIVE TO AN ANVIL OF A SECOND TOOL OF THE CRIMPING PRESS AND A CRIMPING PRESS DEVICE

(71) Applicant: Komax Holding AG, Dierikon (CH)

(72) Inventors: Alois Conte, Ebikon (CH); Bruno Weber, Ballwil (CH); Dominik Feubli, Kriens (CH); Stefan Viviroli, Horw (CH)

(73) Assignee: KOMAX HOLDING AG, Dierikon (CH)

( * ) Notice: Subject to any disclaimer, the term of this patent is extended or adjusted under 35 U.S.C. 154(b) by 44 days.

(21) Appl. No.: 16/605,117

(22) PCT Filed: Apr. 25, 2017

(86) PCT No.: PCT/EP2017/059692
§ 371 (c)(1),
(2) Date: Oct. 14, 2019

(87) PCT Pub. No.: WO2018/196951
PCT Pub. Date: Nov. 1, 2018

(65) Prior Publication Data

US 2021/0143602 A1 May 13, 2021

(51) Int. Cl.
*H01R 43/04* (2006.01)
*H01R 43/048* (2006.01)
*H01R 43/055* (2006.01)

(52) U.S. Cl.
CPC ..... *H01R 43/0486* (2013.01); *H01R 43/055* (2013.01)

(58) Field of Classification Search
CPC ..... H01R 43/0486; H01R 43/055; H01R 43/048; Y10T 29/49174; Y10T 29/49185; Y10T 29/53209; Y10T 29/53226
(Continued)

(56) References Cited

U.S. PATENT DOCUMENTS 4,990,743 A 2/1991 Kugai et al.
8,819,925 B2 * 9/2014 Onuma ..... H01R 43/0486 29/753

(Continued)

FOREIGN PATENT DOCUMENTS

CN 102474061 A 5/2012
CN 104885312 A 9/2015

(Continued)

*Primary Examiner* — Donghai D Nguyen
(74) *Attorney, Agent, or Firm* — William J. Clemens; Shumaker, Loop & Kendrick, LLP

(57) ABSTRACT

A method for aligning a crimper of a first tool relative to an anvil of a second tool in a crimping press, wherein a crimp connection is made by jointly by moving the crimper relative to the anvil in a first direction, includes: moving the crimper relative to the anvil in the first direction until the anvil is partially inside a cavity of the crimper; moving the anvil relative to the crimper in a second direction transverse to the first direction until detecting contact between the anvil and the crimper; moving the anvil relative to the crimper opposite to the second direction until detecting contact between the anvil and the crimper for determining a gap width between the anvil and the crimper; and moving the anvil relative to the crimper in the second direction by a distance which is equal to half of the determined gap width.

17 Claims, 6 Drawing Sheets

(58) Field of Classification Search
USPC ..... 29/857, 861, 863, 747, 751
See application file for complete search history.

(56) References Cited

U.S. PATENT DOCUMENTS

| | | | | |
|---|---|---|---|---|
| 9,391,418 | B2 * | 7/2016 | Stull | H01R 43/0488 |
| 10,144,132 | B2 | 12/2018 | Yokoi | |
| 2012/0124826 | A1 | 5/2012 | Onuma et al. | |
| 2016/0148826 | A1 | 5/2016 | Thallner | |

FOREIGN PATENT DOCUMENTS

| | | | |
|---|---|---|---|
| CN | 105283950 | A | 1/2016 |
| CN | 105965505 | A | 9/2016 |
| EP | 1381123 | A1 | 1/2004 |
| EP | 1381124 | A1 | 1/2004 |
| EP | 1764881 | A1 | 3/2007 |
| EP | 1764882 | A1 | 3/2007 |
| EP | 1764884 | A1 | 3/2007 |
| JP | H1167416 | A | 3/1999 |
| JP | 2001035629 | A | 2/2001 |
| JP | 2011018606 | A | 1/2011 |
| JP | 2011103263 | A | 5/2011 |
| JP | 2013254687 | A | 12/2013 |
| WO | 0163704 | A1 | 8/2001 |

* cited by examiner

METHOD FOR ALIGNING A CRIMPER OF A FIRST TOOL OF A CRIMPING PRESS RELATIVE TO AN ANVIL OF A SECOND TOOL OF THE CRIMPING PRESS AND A CRIMPING PRESS DEVICE

FIELD

The present invention relates to a method for aligning a crimper of a first tool of a crimping press relative to an anvil of a second tool of the crimping press and to a crimping press device.

BACKGROUND

By "crimping" there is understood the production of a non-detachable electrical and mechanical connection (crimp connection) by plastic deformation between a wire and a crimp contact. Typically, crimping devices each having two tools are used to produce crimp connections of this type: an anvil tool (often the lower part of the crimping device), which is employed like an anvil and may be used for the purpose of supporting the crimp contact and an insulation-stripped cable end to be connected to the crimp contact from one side, and a stamp tool (often the upper part of the crimping device), which is used for the purpose of pressing the crimp contact together with the cable end to be connected against the anvil tool and deforming it suitably. The crimp connection between a crimping contact and a wire, for example, insulation-stripped strands or complete conductors of copper or steel, is made by moving a crimper of a first tool relative to an anvil of a second tool of a crimping press. A crimping press device having two tools is known from EP 1 381 123 A1, each of the tools being implemented as a replaceable part and each of the tools being exchangeable independently of the other tool. The crimper, which is part of the first/upper tool, is led in a sliding guide. For crimping, i.e., connecting or joining a cable/wire with a crimp contact, the crimper of the crimping device has to be aligned to the anvil of the crimping device. The better the alignment between the crimper and the anvil is, the higher the quality of the crimp connection is. In particular relevant is the offset in a second direction in which the crimp contacts are fed to the crimping device. When changing one or both of the tools the alignment between the crimper and the anvil has to be redone.

One object of the present invention is to provide a method for aligning a crimper of a first tool of a crimping press relative to an anvil of a second tool of the crimping press which can be executed technically easily, reliably and fast with a high precision and to provide a crimping press device wherein a crimper of the crimping press device can be aligned relative to an anvil of the crimping press device technically easily, reliably and fast.

SUMMARY

In particular, the object is solved by a method for aligning a crimper of a first tool of a crimping press relative to an anvil of a second tool of the crimping press, wherein the crimper and the anvil are adapted for making a crimp connection jointly by moving the crimper relative to the anvil in a first direction, wherein the method comprises the following steps: moving the crimper relative to the anvil into the first direction until the anvil is partially inside a cavity of the crimper; moving the anvil relative to the crimper in a second direction which is transverse to the first direction until a contact between the anvil and the crimper is detected; moving the anvil relative to the crimper opposite to the second direction until a contact between the anvil and the crimper is detected for determining a value of a gap between the anvil and the crimper; and moving the anvil relative to the crimper in the second direction by a distance which is equal to half of the determined value of the gap.

One advantage hereof is typically that the crimper can be aligned relative to the anvil in a very short time. Thus, usually, after installing and/or changing the crimper and/or the anvil, the crimper can be realigned in a very short time relative to the anvil. Also, generally, the alignment is achieved reliably. Generally, after applying this method, the anvil is at the center of the crimper, and vice versa. Therefore, typically, the crimping press can—after applying the method—produce crimp connections with a very high quality. Furthermore, in general, no direct optical measurement/alignment of the anvil/crimper is necessary. Thus, typically, the method can be executed even in bad lighting (or even complete darkness). In addition, typically, the method can be executed reliably in a dirty environment.

Moving the anvil relative to the crimper can comprise moving the anvil physically, moving the crimper physically or moving the anvil as well as the crimper physically.

The cited features of the method can but do not have to be carried out as steps one after the other in the given order. Some cited features of the methods can be carried out at the same time.

In particular, the object is also solved by a crimping press device comprising—a crimping press which comprises a first tool with a crimper and a second tool with an anvil, wherein the crimper and the anvil are adapted for making a crimp connection jointly by moving the crimper relative to the anvil in a first direction,—a detection device for detecting a contact between the crimper and the anvil, and—an aligning device for aligning the anvil in a center of a cavity of the crimper, wherein the aligning device is adapted—for moving the anvil relative to the crimper in a second direction which is transverse to the first direction until a contact between the anvil and the crimper inside the cavity of the crimper is detected; —for moving the anvil relative to the crimper opposite to the second direction until a contact between the anvil and the crimper inside the cavity of the crimper is detected for determining a value of a gap between the anvil and the crimper; and—for moving the anvil relative to the crimper in the second direction by a distance which is equal to half of the determined value of the gap between the anvil and the crimper.

One advantage hereof is typically that the crimper can be aligned relative to the anvil in a very short time. Thus, usually, after installing and/or changing the crimper and/or the anvil, the crimper can be realigned relative to the anvil in a very short time. Also, generally, the alignment is achieved reliably. Generally, the anvil can be aligned at the center of the crimper, and vice versa, technically easily. Therefore, typically, the crimping press can produce crimp connections with a very high quality. Furthermore, in general, no direct optical measurement/alignment of the anvil/crimper is necessary. Thus, typically, the crimper can be aligned relative to the anvil even in bad lighting (or even complete darkness). In addition, typically, the alignment can be executed reliably in a dirty environment.

Further features and advantageous effects of embodiments of the invention can among others and without limiting be based on the following ideas and findings.

According to an embodiment, the contact between the anvil and the crimper is detected via force sensors, in particular at least three force sensors, which are arranged between a receptacle for the anvil and a body of the crimping press. By this, typically, the contact between the anvil and the crimper can be detected technically especially easily. Furthermore, in general, pressure sensors which are already present at some crimping presses for measuring the crimping force during the crimping process can be used for detecting the contact between the anvil and the crimper; thus, no further measurement sensors are needed, normally. This saves costs usually.

According to an embodiment, the anvil is moved via a driver, and wherein the contact between the anvil and the crimper is detected via a deformation of the driver. By this, typically, the contact between the anvil and the crimper can be detected technically especially easily. In general, in particular, the deformation can be measured via one or more than one strain gauges. In addition, typically, such a driver for moving the anvil can be retrofitted at existing crimping presses.

According to an embodiment, when moving the anvil the second tool is moved as a whole. One advantage thereof is that typically moving the second tool as a whole is mechanically especially simple.

According to an embodiment, the anvil or the second tool is moved via a servo motor. By this, normally, the anvil or the anvil together with the second tool can be moved relative to the crimper very precisely. Thus, usually, the anvil can be aligned centrally to the crimper (and vice versa) with a high precision. Therefore, typically, crimp connections with a very high quality can be achieved.

According to an embodiment, the servo motor moves the anvil or the second tool via a cam shaft. One advantage hereof is that only a small amount of space is needed for carrying out the method, typically.

According to an embodiment, the anvil or the second tool is moved via a spindle drive with shaft joint. By this, typically, the anvil can be moved relative to the crimper very precisely. Thus, the anvil can be aligned centrally to the crimper (and vice versa) with a high precision, usually. Therefore, typically, crimp connections with a very high quality can be achieved.

According to an embodiment, the crimping press further comprises force sensors, in particular at least three force sensors, for detecting the contact between the anvil and the crimper, wherein the force sensors are arranged between a receptacle for the anvil and a body of the crimping press. By this, typically, the contact between the anvil and the crimper can be detected technically especially easily.

According to an embodiment, the force sensors comprise piezoelectric elements. Typically, one advantage hereof is that the contact between the crimper and the anvil can be detected very fast and precisely. Furthermore, piezo electric elements are low priced, usually.

According to an embodiment, the crimping press device further comprises a driver for moving the anvil, and wherein the aligning device is adapted for detecting the contact between the crimper and the anvil via a deformation of the driver. By this, typically, the contact between the anvil and the crimper can be detected technically especially easily. In general, in particular, the deformation can be measured via one or more than one strain gauges. In addition, typically, a driver for moving the anvil can be retrofitted at existing crimping presses.

According to an embodiment, the aligning device is adapted for moving the second tool as a whole for moving the anvil. One advantage thereof is that typically moving the second tool as a whole is mechanically especially simple.

According to an embodiment, the crimping press further comprises a servo motor for moving the anvil or the second tool. By this, normally, the anvil or the anvil together with the second tool can be moved relative to the crimper very precisely. Thus, usually, the anvil can be aligned centrally to the crimper (and vice versa) with a high precision. Therefore, typically, crimp connections with a very high quality can be achieved.

According to an embodiment, the servo motor drives a cam shaft which moves the anvil and/or the second tool. One advantage hereof is that only a small amount of space is needed for the crimping press, typically.

According to an embodiment, the crimping press further comprises a spindle drive with shaft joint for moving the anvil or the second tool. By this, typically, the anvil can be moved relative to the crimper very precisely. Thus, the anvil can be aligned centrally to the crimper (and vice versa) with a high precision, usually. Therefore, typically, crimp connections with a very high quality can be achieved.

It may be noted that possible features and/or benefits of embodiments of the present invention are described herein partly with respect to a method for aligning a crimper of a first tool of a crimping press relative to an anvil of a second tool of the crimping press and partly with respect to a crimping press device. A person skilled in the art will understand that features described for embodiments of a method for aligning a crimper of a first tool of a crimping press relative to an anvil of a second tool of the crimping press may be applied in analogy in an embodiment of a crimping press device according to the invention, and vice versa. Furthermore, one skilled in the art will understand that features of various embodiments may be combined with or replaced by features of other embodiments and/or may be modified in order to come to further embodiments of the invention.

In the following, embodiments of the invention will be described herein with reference to the enclosed drawings. However, neither the drawings nor the description shall be interpreted as limiting the invention.

Figure 1:
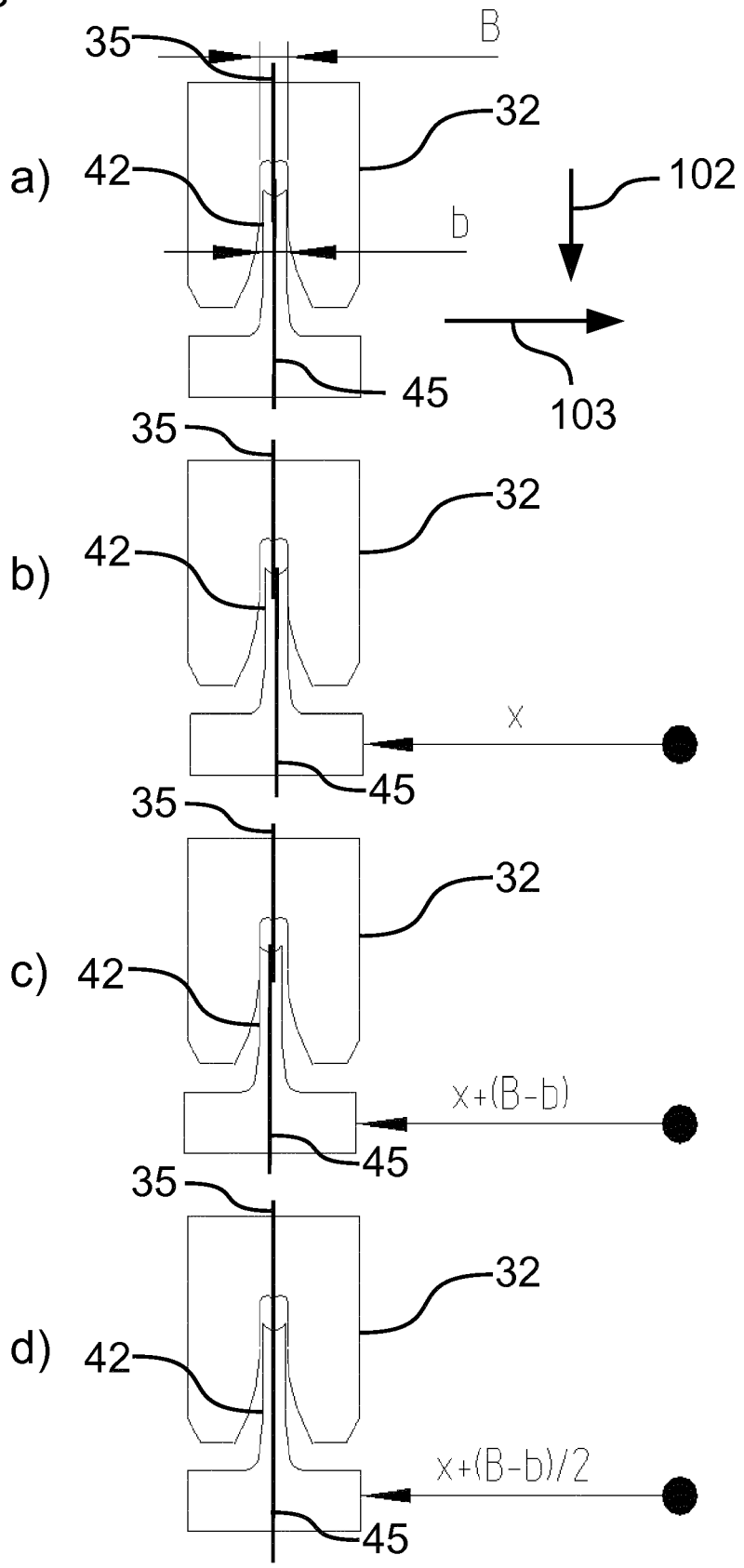
FIG. 1*a*)-1*d*) show schematic side views of a crimping press device of an embodiment according to the present invention during the process of aligning the crimper relative to the anvil.

The figures are only schematic representations and not to scale. Same reference signs indicate same or similar features.

DETAILED DESCRIPTION

FIG. 1*a*)-1*d*) show schematic side views of a crimping press device 10 (FIG. 2) of an embodiment according to the present invention during the process of aligning a crimper 32 of relative to an anvil 42. FIG. 1*a*)-d) show the position of a crimper 32 of a first tool 30 (upper tool FIG. 2) of a crimping press device 10 relative to an anvil 42 of a second tool 40 (lower tool FIG. 2) of a crimping press device 10. In FIG. 1*b*)-d) the (sum of the) distances which the anvil 42 has been moved relative to the crimper 32 are shown.

Figure 2:
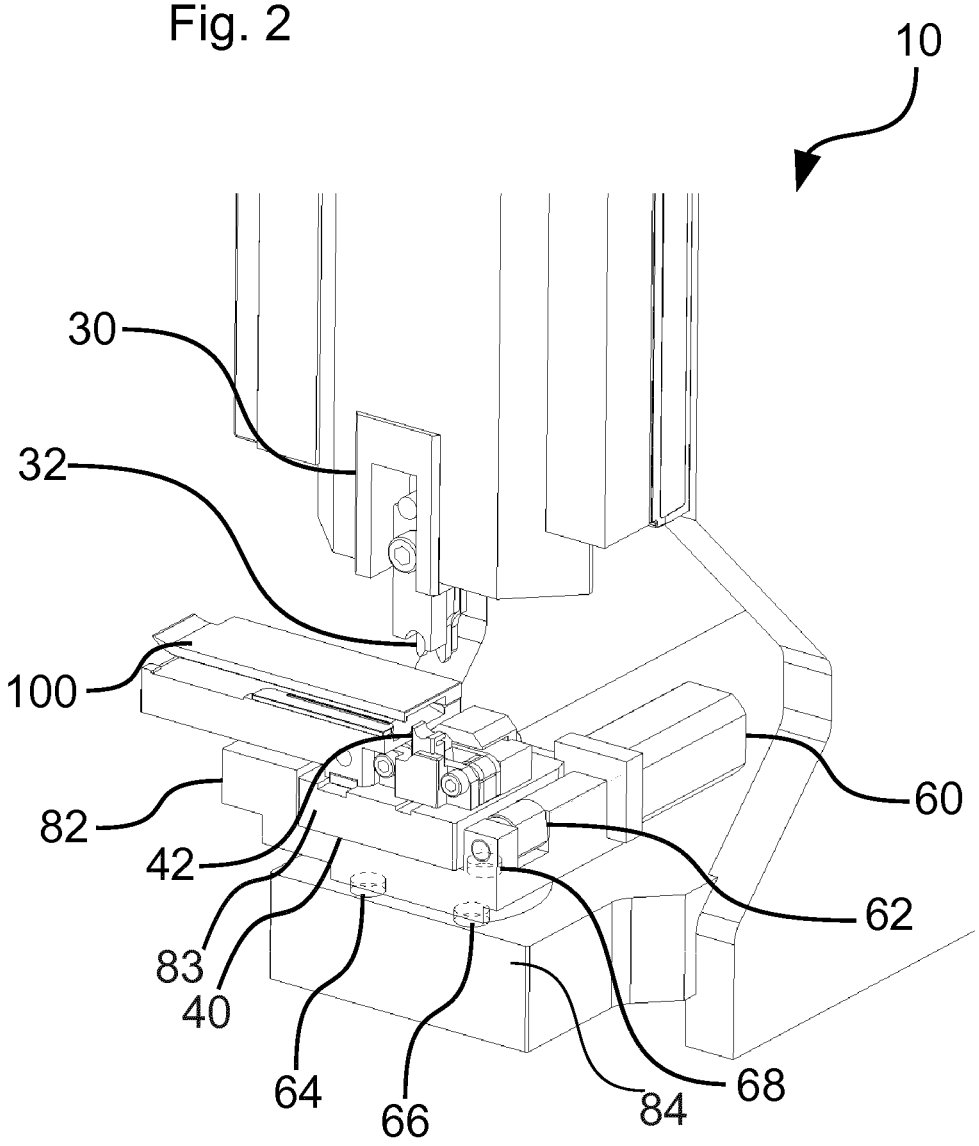
FIG. 2 shows a perspective view of a crimping press device of a first embodiment according to the present invention.
Figure 3:
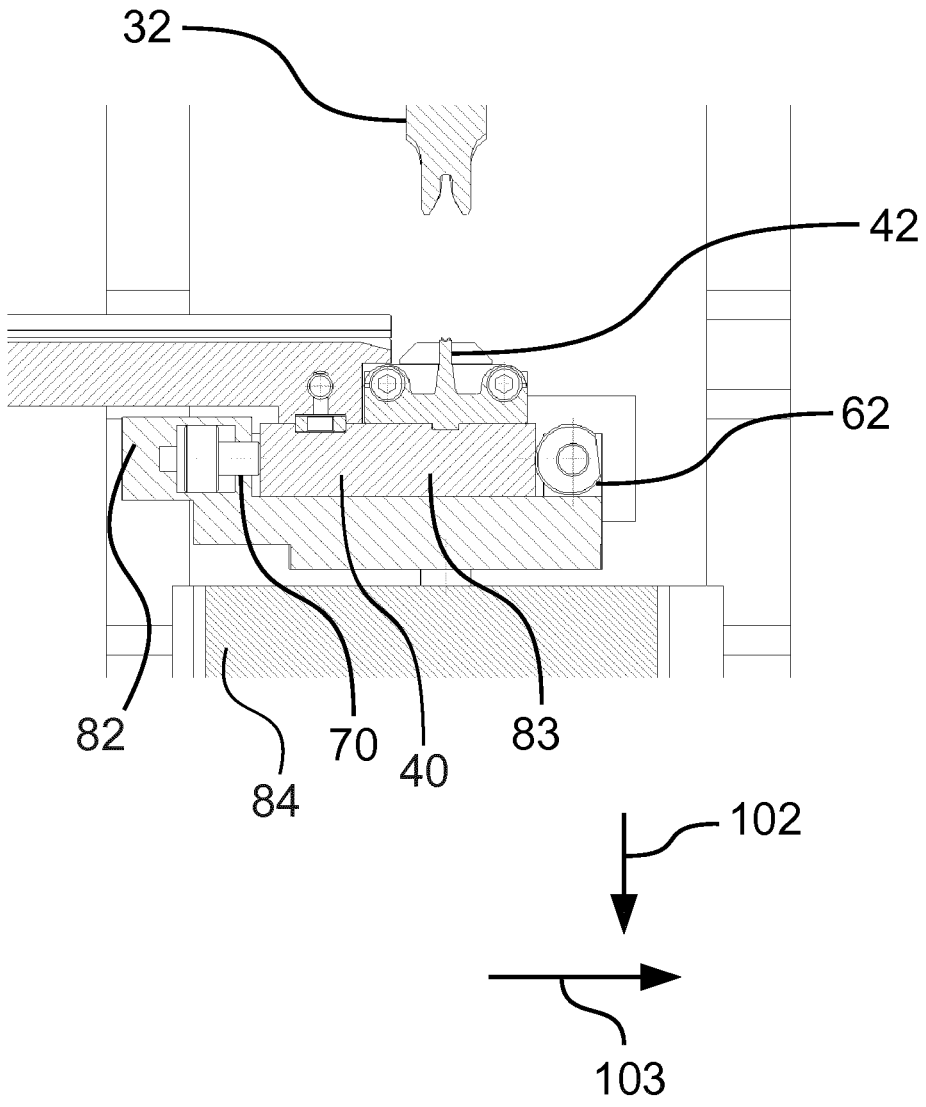
FIG. 3 shows a cross-sectional view of the crimping press device of FIG. 2.

FIG. 2 shows a perspective view of a crimping press device 10 of a first embodiment according to the present invention. FIG. 3 shows a cross-sectional view of the crimping press device 10 of FIG. 2.

The crimping press device 10 comprises a crimping press. The crimping press makes a crimp connection between crimping contacts and a wire/a cable. The crimping contacts and the wire are fed via a crimp contact feed 100 from the right or the left in FIG. 1. For a crimp connection with high quality the center of the anvil 42 has to be aligned to the crimper 32 or at the center of the crimper 32. The crimper 32 comprises a cavity 33 in which a part of the anvil 42 is disposed when the crimper 32 and the anvil 42 are in the crimping position.

Width B is the width of the cavity 33 of the crimper 32 along the second direction 103 (at its smallest diameter). Width b is the width of the anvil 42 (at its smallest diameter) in the second direction 103. The second direction 103 runs from left to right in FIG. 1*a*)-1*d*).

The crimper 32 which is usually the part/tool which can be moved up or down is moved down into the position at which the crimp connection is made. This direction is also called first direction 102. The first direction 102 runs from the top to the bottom in FIG. 1. The position in which the crimper 32 and the anvil 42 are in the crimp position is shown in FIG. 1. In this position, part of the anvil 42 is inside the cavity 33 of the crimper 32. FIG. 1*a*) shows this starting position.

Then the anvil 42 is moved relative to the crimper 32 in a second direction 103 which is transverse to the first direction 102. The anvil 42 is moved by the distance x until the anvil 42 contacts the crimper 32. The anvil 42 contacts an inner surface of the cavity 33 of the crimper 32. The second direction 103 runs from left to right in FIG. 2 (or vice versa). The second direction 103 can be perpendicular to the first direction 102. It is also possible that the second direction 103 is not perpendicular to the first direction 102. The crimper 32 can be moved additionally up or down relative to the anvil 42 in FIG. 1*a*)-1*d*) while being moved relative to the anvil 42 in the second direction 103.

Moving the anvil 42 relative to the crimper 32 can comprise moving the anvil 42 physically, moving the crimper 32 physically or moving the anvil 42 as well as the crimper 32 physically.

The moving of the anvil 42 relative to the crimper 32 is stopped as soon as a physical/mechanical contact between the anvil 42 and the crimper 32 (inside the cavity 33 of the crimper 32) is detected. This means that the crimper 32 has been moved relative to the anvil 42 as far as possible (without damaging the crimper 32 and/or the anvil 42). FIG. 1*b*) shows the position when the anvil 42 has been moved relative to the crimper 32 as far as possible to the right.

Then the anvil 42 is moved relative to the crimper 32 opposite to the second direction 103. The anvil 42 is moved to the left between FIG. 1*b*) and FIG. 1*c*). The opposite direction to the second direction 103 does not have to be "opposite" in a strictly mathematical sense. In FIG. 1 the anvil 42 is moved to the left, which is the opposite to the second direction 103, wherein the second direction 103 runs from left to right.

The anvil 42 is moved relative to the crimper 32 such that the anvil 42 moves away from an inner surface of the cavity 33 of the crimper 32 which the anvil 42 touched (or vice versa). This movement is stopped as soon as soon as the anvil 42 touches the crimper 32/the other inner surface of the cavity of the crimper 32. This position is shown in FIG. 1*c*).

During the moving of the anvil 42 relative to the crimper 32 opposite to the second direction 103 (i.e., during the movement between FIG. 1*b*) and FIG. 1*c*)) the distance of the movement of the anvil 42 relative to the crimper 32 is measured. I.e., the distance of movement of the anvil 42/crimper 32 from the position shown in FIG. 1*b*) to the position shown in FIG. 1*c*) is measured. This distance (which is equal to "B-b") is equal to the width of the gap between the anvil 42 and the crimper 32. In FIG. 1*a*), there are two gaps (on the left and on the right side of the anvil 42) between the anvil 42 and the crimper 32, so this measured distance during the movement opposite to the second direction 103 is equal to the sum of the two gaps of FIG. 1*a*).

Finally, the anvil 42 is moved relative to the crimper 32 in the second direction 103 by a distance which is equal to half of the measured distance, i.e., which is equal to "(B−b)/2". The anvil 42 is moved relative to the crimper 32 from left to right. The final position of the anvil 42 and the crimper 32 is shown in FIG. 1*d*). This movement is done in FIG. 1 from left to right.

After these steps, the anvil 42 is aligned to the crimper 32. I.e., the center of the anvil 42 is located in the center of the cavity 33 of the crimper 32. This means that a center line 35 of the crimper 32 which runs from top to bottom in FIG. 1 and through the center of the crimper 32 is aligned to a center line 45 of the anvil 42 which runs from top to bottom in FIG. 1 and through the center of the anvil 42.

After this alignment, crimp connections with a high quality can be produced via the anvil 42 and the crimper 32. The value of the gaps on both opposing sides (left side and right side in FIG. 1*d*)) of the anvil 42 between the anvil 42 and the crimper 32 are equal.

In sum: the anvil 42 is moved relative to the crimper 32 in a first (arbitrary direction) as far as possible, i.e., until a contact between the anvil 42 and the crimper 32, is present; then is it moved as far as possible in the other direction until a contact between the anvil 42 and the crimper 32 is detected again while the distance the anvil 42 has been moved relative to the crimper 32 is being measured; then the anvil 42 is moved relative to the crimper by half the distance measured.

Additional movement of the crimper 32 relative to the anvil 42 in the first direction 102 or other directions during the movements of the crimper 32 relative to the anvil 42 in the second direction 103 and/or opposite to the second direction 103 is possible. Also, movements in a third direction, which is transverse to the first direction 102 and the second direction 103, are possible during these movements of course.

As can be seen from FIG. 2, the anvil 42 comprising a mating member for the crimper 32 (crimping die) is arranged on a base plate 83. The anvil 42 is received and kept movable in a receptacle 82. The anvil 42 together with the base plate 83 is clamped between a cam shaft 62 and the clamping bolt 70 (FIG. 3). The cam shaft 62 is driven by a servo motor 60 for moving the anvil 42 relative to the crimper 32 in the second direction 103. The clamping bolt 70 can be pre-loaded pneumatically. The clamping bolt 70 can be moved pneumatically to the left in FIG. 3 so that the lower tool/second tool 40 can be ex-changed.

The anvil 42 is moved with the whole second tool 40 of the crimping press. The clamping bolt 70 follows the movement of the anvil 42, i.e., gives way for the movement of the anvil 42.

The receptacle 82 lies or rests on a machine table or another part of the body 84 of the crimping press. Between the receptacle 82 and said body 84 several crimping force sensors 64, 66, 68 (also called pressure sensors) are provided. The number of force sensors 64, 66, 68 shown in FIG. 2 is three. Two, four, five or more than five force sensors are also possible. The force sensors 64, 66, 68 are arranged in a triangle. Other forms of the arrangement, e.g., a linear arrangement or in a square-form, are possible.

The force sensors 64, 66, 68 are adapted to detect a contact between the anvil 42 and the (inner surface of the cavity of the) crimper 32. As soon as the anvil 42 touches the crimper 32 the distribution of the weight force of the anvil 42 over the force sensors 64, 66, 68 changes. Furthermore, the distribution of the force among the force sensors 64, 66, 68 changes when the anvil 42 contacts the crimper 32 (or vice versa). This is detected, e.g., via a control unit/computer (not shown). Furthermore, it can be detected which inner surface of the crimper 32 (i.e., the left or the right inner surface of the cavity of the crimper 32) has been touched by the anvil 42 via the force sensors 64, 66, 68 due to the different changes of the weight force.

The force sensors 64, 66, 68 can be piezo-electric force sensors or piezo-electric pressure sensors.

The position of the cam shaft 62 can be measured via an encoder. The angle position of the cam shaft 62 can be transferred into a linear position of the anvil 42. By this, the distance which the anvil 42 is moved relative to the crimper 32 opposite to the second direction 103 can be measured with a high quality. Thus, the anvil 42 can be moved relative to the crimper 32 in the second direction 103 by half of the measured distance (of the gap between the anvil 42 and the crimper 32) very precisely.

This way, the anvil 42 can be aligned relative to the crimper 32 very precisely, i.e., the center line 45 (FIG. 1) of the anvil 42 (running through the center of the anvil 42 from top to bottom in FIG. 3) is very close to the center line 35 (FIG. 1) of the crimper 32 (running through the center of the crimper 32 from top to bottom in FIG. 3). The (closest) distance between the center lines 35, 45 after aligning the anvil 42 relative to the crimper 32 can be, for example, less than 10 μm, less than 5 μm or less than 1 μm.

It is also possible that a physical contact between the anvil 42 and the crimper 32 is detected via an electric current/signal. A voltage is applied between the anvil 42 and the crimper 32. The voltage is low such that no current breaks through the air between the anvil 42 and the crimper 32. Only when a physical/mechanical contact between the crimper 32 and the anvil 42 is made, a current runs between the crimper 32 and the anvil 42. The current can be detected via a measuring device. As soon as a current flows between the crimper 32 and the anvil 42, a physical contact between the crimper 32 and the anvil 42 is present. Thus, the movement of the crimper 32 relative to the anvil 42 or the movement of the anvil 42 relative to the crimper 32 can be achieved with a (digital) electric signal and the detection of a contact between the anvil 42 and the crimper 32 can be also detected via a (digital) electric signal. This simplifies the method for detecting a physical contact between the crimper 32 and the anvil 42.

Figure 4:
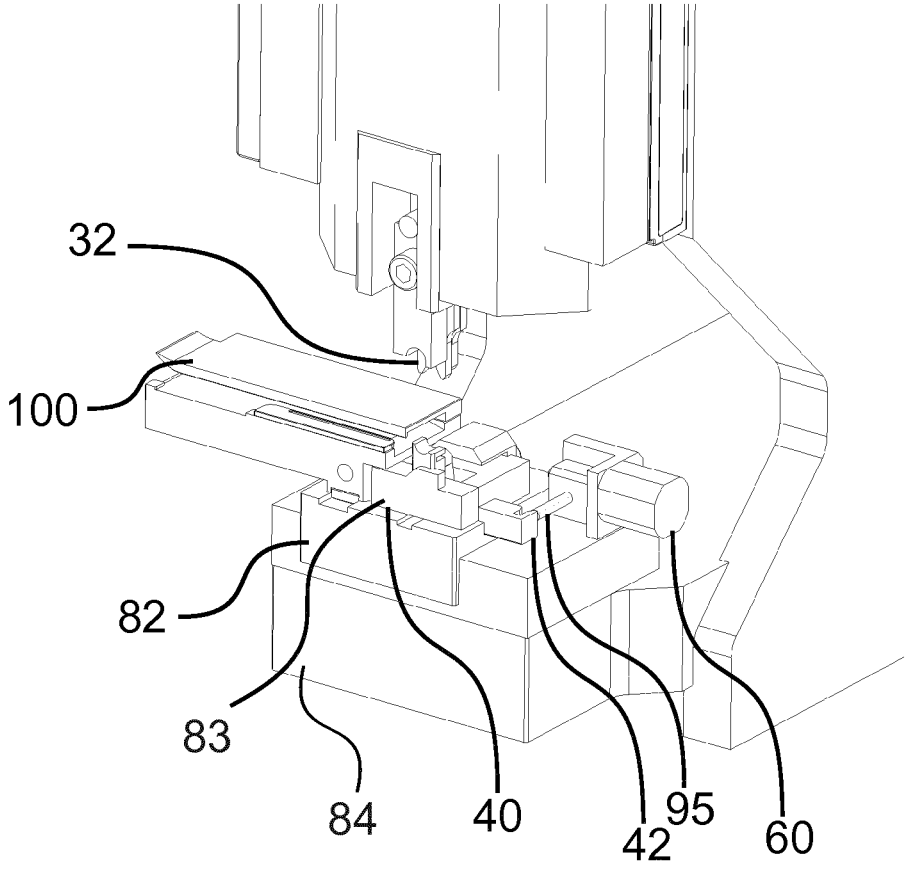
FIG. 4 shows a perspective view of a crimping press of a second embodiment according to the present invention.
Figure 5:
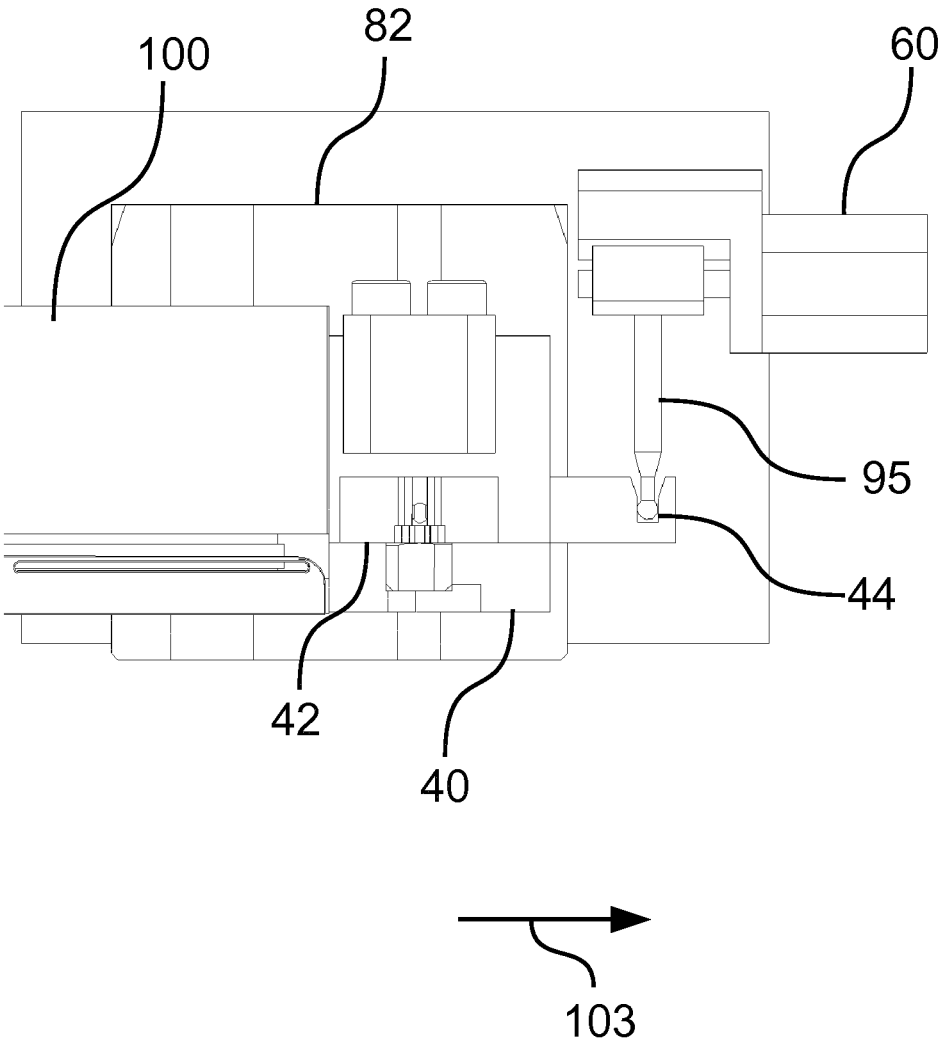
FIG. 5 shows a top view on a lower part of the crimping press of FIG. 4.
Figure 6:
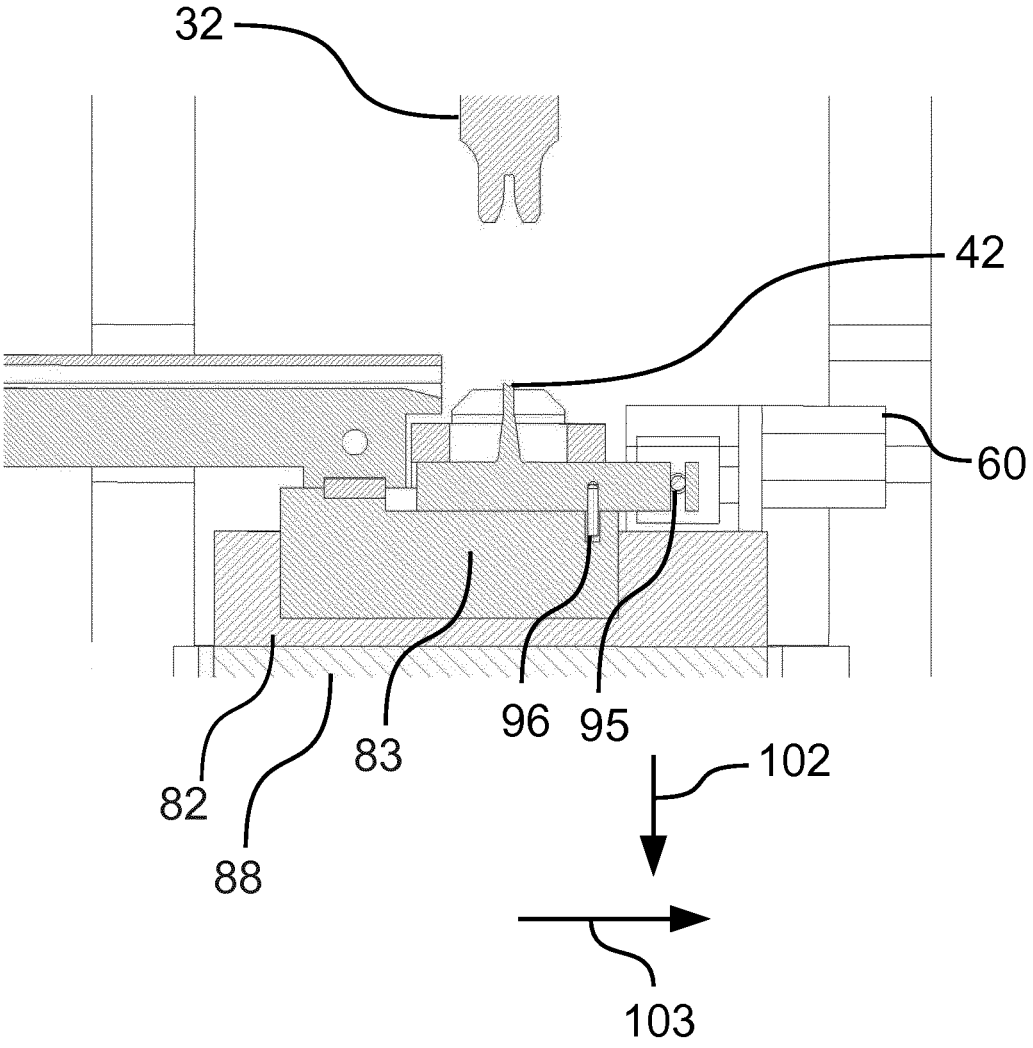
FIG. 6 shows a cross-sectional view of the crimping press of FIG. 4 and FIG. 5.

FIG. 4 shows a perspective view of a crimping press device 10 of a second embodiment according to the present invention. FIG. 5 shows a top view on a lower part of the crimping press of FIG. 4. FIG. 6 shows a cross-sectional view of the crimping press device 10 of FIG. 4 and FIG. 5.

The crimping press device comprises a crimp contact feed 100 which feeds and leads crimp contacts to the anvil 42 and the crimper 32. The crimp contacts are connected via a crimp connection to the wire or cable. This is done by moving the crimper 32 in the direction of the anvil 42.

In this second embodiment, only the anvil 42 of the second tool 40 is moved. The anvil 42 is movable mounted on the base plate 83 whereas the base plate 83 is received and fixed in or on the receptacle 82. A servo motor 60 moves the anvil 42 via a driver 95 which engages into a groove 44 of the anvil 42. The movement of the anvil 42 is limited by a pin 96. The pin 96 is fixed in the anvil 42.

In the base plate 83, the pin 96 can be moved in the second direction 103 and opposite to the second direction 103. The cavity of the base plate 83 in which the pin 96 is disposed is larger than the diameter of the pin 96. However, the cavity of the receptacle 82 for receiving the pin 96 is only slightly larger than the pin. E.g., the diameter of the cavity of the base plate 83 is ca. 1.2, ca. 1.3 or ca. 1.4 times larger than the diameter of the pin 96.

The anvil 42 is moved linearly by the servo motor 60. The servo motor 60 can be a spindle drive with shaft joint. The position of the spindle drive with shaft joint can be measured via an encoder and/or a linear measuring system. Thus, the distance during the movement of the anvil 42 relative to the crimper 32 from the position shown in FIG. 1*b*) to the position shown in FIG. 1*c*) can be measured precisely.

A contact between the anvil 42 and the crimper 32 can be detected via a deformation of the driver 95. For this, the deformation of the driver 95 can be measured/detected via one or several strain gauges. The strain gauge or strain gauges can be disposed along the length of the driver 95. The length of the driver 95 runs from top to bottom in FIG. 5. As soon as a deformation of the driver 95 is detected, it is determined that a (physical) contact between the anvil 42 and the crimper 32 has occurred.

The deformation of the driver 95 is only temporary. I.e., the deformation of the driver 95 is reversible. As soon as there are no external forces acting on the driver 95 anymore, the driver 95 returns to its original form. The original form is shown in FIG. 5.

The strain gauges can be disposed on opposite sides of the driver 95. This way, a contact of the anvil 42 with each of the opposing inner surfaces of the crimper 32 can be detected technically easily. Other elements and/or methods for detecting a deformation of the driver 95 are possible.

When changing the second tool 40 with the anvil 42, i.e., the lower tool, the second tool 40 is inserted into the receptacle 82 from the front (in FIG. 5 from the bottom; in FIG. 6 into the plane of projection). Thus, the driver 95 engages the groove 44 of the anvil 42. The driver 95 can have a tip which has the form of a ball or sphere. After changing the tool 30, 40, the method for aligning the anvil 42 relative to the crimper 32 can be carried out.

The first tool 30/upper tool is led in a sliding guide. The only movement of the upper tool/crimper 32 possible is in/along the first direction 102. The first direction 102 runs from the top to the bottom in FIG. 1, FIG. 3 and FIG. 6. In the other directions, in particular in the directions perpendicular to the first direction 102, no movement of the crimper 32 is possible.

The roles of the crimper 32 and the anvil 42 can be reversed in the sense that the anvil 42/second tool 40 is led in a sliding guide such that only a movement of the anvil 42 in the first direction 102 is possible, while the crimper 32 is moved physically. This way, an alignment between the anvil 42 relative to the crimper 32 can be achieved, too. Furthermore, is it possible that both the anvil 42 and the crimper 32 are moved physically.

Finally, it should be noted that terms such as "comprising" do not exclude other elements or steps and the "a" or "an" does not exclude a plurality. Also, elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for aligning a crimper of a first tool of a crimping press device relative to an anvil of a second tool of the crimping press device, wherein the crimper and the anvil are adapted for making a crimp connection jointly by moving the crimper relative to the anvil in a first direction, the method comprising the following steps:

moving the crimper relative to the anvil in the first direction until the anvil is partially inside a cavity of the crimper;

moving the anvil relative to the crimper in a second direction transverse to the first direction until a contact between the anvil and the crimper inside the cavity is detected;

moving the anvil relative to the crimper in a direction opposite to the second direction until a contact between the anvil and the crimper inside the cavity is detected and determining a width of a gap between the anvil and the crimper based upon the movement in the opposite direction; and moving the anvil relative to the crimper in the second direction by a distance which is equal to half of the determined width of the gap.

2. The method according to claim 1 wherein the contact between the anvil and the crimper is detected via a plurality of force sensors arranged between a receptacle for the anvil and a body of the crimping press.

3. The method according to claim 2 wherein the plurality of force sensors includes at least three of the force sensors.

4. The method according to claim 1 including moving the anvil with a driver, and wherein the contact between the anvil and the crimper is detected via a deformation of the driver.

5. The method according to claim 1 wherein when moving the anvil the second tool is moved as a whole.

6. The method according to claim 1 including moving the anvil or the second tool with a servo motor.

7. The method according to claim 6 wherein the servo motor moves the anvil or the second tool via a cam shaft.

8. The method according to claim 1 including moving the anvil or the second tool with a spindle drive having a shaft joint.

9. A crimping press device comprising:

a first tool with a crimper and a second tool with an anvil, wherein the crimper and the anvil are adapted for making a crimp connection jointly by moving the crimper relative to the anvil in a first direction;

a detection device for detecting a contact between the crimper and the anvil;

an aligning device for aligning the anvil in a center of a cavity of the crimper;

wherein the aligning device moves the anvil relative to the crimper in a second direction that is transverse to the first direction until a contact between the anvil and the crimper inside the cavity of the crimper is detected by the detection device;

wherein the aligning device moves the anvil relative to the crimper in a direction opposite to the second direction until a contact between the anvil and the crimper inside the cavity of the crimper is detected for determining a width of a gap between the anvil and the crimper; and wherein the aligning device moves the anvil relative to the crimper in the second direction by a distance equal to half of the determined width of the gap between the anvil and the crimper.

10. The crimping press device according to claim 9 including a plurality of force sensors for detecting the contact between the anvil and the crimper and being arranged between a receptacle for the anvil and a body of the crimping press.

11. The crimping press device according to claim 10 wherein the plurality of force sensors includes at least three of the force sensors.

12. The crimping press device according to claim 10 wherein the force sensors are piezoelectric elements.

13. The crimping press device according to claim 9 including a driver for moving the anvil, and wherein the aligning device is adapted for detecting the contact between the crimper and the anvil via a deformation of the driver.

14. The crimping press device according to claim 9 wherein the aligning device is adapted for moving the second tool as a whole for moving the anvil.

15. The crimping press device according to claim 9 including a servo motor for moving the anvil or the second tool.

16. The crimping press device according to claim 15 wherein the servo motor drives a cam shaft that moves the anvil or the second tool.

17. The crimping press device according to claim 9 including a spindle drive with a shaft joint for moving the anvil or the second tool.

* * * * *